United States Patent [19]

Granderson

[11] 4,315,623

[45] Feb. 16, 1982

[54] SKIPPING HOOP APPARATUS

[76] Inventor: Hermas L. Granderson, P.O. Box 1263, Columbus, Miss. 39701

[21] Appl. No.: 112,795

[22] Filed: Jan. 16, 1980

[51] Int. Cl.[3] ..... A63B 5/22

[52] U.S. Cl. ..... 272/74

[58] Field of Search ..... 272/74, 75; 46/47, 51

[56] References Cited

U.S. PATENT DOCUMENTS

| | | | |
|---|---|---|---|
| 104,674 | 6/1870 | Whitehead | 272/74 |
| 169,625 | 11/1875 | Crandall | 272/74 |
| 554,992 | 2/1896 | Donnellan | 272/75 |
| 2,004,817 | 6/1935 | Linney | 46/52 X |
| 2,493,224 | 1/1950 | Brunt et al. | 272/74 |
| 2,919, 919 | 1/1960 | Ebb | 46/52 X |
| 3,212,777 | 10/1965 | Spoczynski | 272/75 |
| 3,612,522 | 10/1971 | Ekonen | 272/75 |
| 3,633,925 | 1/1972 | Deese | 272/75 |
| 4,022,462 | 5/1977 | Peña-Kipper | 272/74 |
| 4,094,502 | 6/1978 | Cook | 272/74 |

FOREIGN PATENT DOCUMENTS

| | | | |
|---|---|---|---|
| 1211130 | 11/1970 | United Kingdom | 272/74 |

OTHER PUBLICATIONS

"Girls World", Jan. 1972, p. 6.

*Primary Examiner*—Richard C. Pinkham
*Assistant Examiner*—T. Brown
*Attorney, Agent, or Firm*—Wigman & Cohen

[57] ABSTRACT

A skipping hoop amusement and exercising apparatus is disclosed and comprises an elliptically shaped hoop formed of plastic pipe and including a curved hoop member connected to a handle having a pair of tubular handgrips freely slidable therealong. A noisemaker, such as a vibrating reed, is affixed to the hoop for generating an audible sound when the hoop is swung through the air above a certain velocity.

3 Claims, 3 Drawing Figures

SKIPPING HOOP APPARATUS

BACKGROUND OF THE INVENTION

The present invention relates to amusement and exercising devices and more particularly to a skipping hoop or jumping hoop of the type which is used in a manner similar to a jump rope.

A search of the prior art failed to uncover any prior art references which disclose the novel skipping hoop of the present invention. A number of prior art patents were uncovered which disclose a variety of skipping, jumping, and exercising hoops. The following is a list of the prior art patents uncovered during the aforementioned search:

U.S. Patent Nos.

67,101
104,674
259,440
2,493,224
3,072,402
3,074,717
3,118,666
3,466,032
3,493,229
3,958,802
4,022,462
4,094,502
4,135,713

When operated by a user or skipper, these prior art skipping devices provide no amusement or diversion other than the mere physical activity or exercise of skipping or jumping. Accordingly, the interest of the user tends to wane quickly, particularly in the case of children.

In addition, generally speaking, prior art skipping hoops are configured to maximize the space available for the passage of the feet of the user through the hoop when the same is operated. Thus, the shape or form of the prior art hoops, such as those described and illustrated in the above-listed patents, is generally rectangular or circular at the portion thereof which passes under the feet and over the head of the user.

SUMMARY AND OBJECTS OF THE INVENTION

In view of the foregoing drawbacks of the prior art skipping hoop devices, as well as other disadvantages not specifically mentioned above, it should be apparent that there still exists a need in the art for a skipping hoop device which enhances the amusement and enjoyment of the user and, furthermore, which makes possible a greater degree of exercise difficulty and, thus, is a greater exercising benefit to the user, as well as a greater test of the user's skill. It is, therefore, a primary objective of this invention to fulfill this need by providing an economically constructed, generally elliptically configured skipping hoop which includes means for generating an audible signal in response to operation of the device.

More particularly, it is an object of this invention to provide a skipping hoop device formed of interconnected sections of synthetic plastic pipe, the hoop portion of the device being elliptically configured and supporting one or more noisemakers, such as vibrating reed elements or the like. These noisemaker elements are adapted to generate an audible signal or tone when the user swings the hoop in a circular motion through the air at a certain minimum velocity. Although a single noisemaker element may be used, a symmetrical arrangement of two, four, etc., is preferred for balance.

Briefly described, the aforementioned objects are accomplished according to the invention by providing a skipping hoop formed of a semi-rigid plastic pipe material configured as one-half of an ellipse. A plastic pipe handle, preferably formed of the same semi-rigid plastic material as the hoop part extends between the free ends of the hoop and is interconnected with such ends by means of right-angle plastic elbows. Preferably, a pair of tubular plastic handgrips are arranged on the handle so as to be slidable therealong.

The elliptical shape of the hoop minimizes the lateral space at the extremity thereof for passage of the feet of the user as compared with the rectangular or circular shape of the prior art hoops. In addition, in a preferred form, the tubular plastic handgrips are not fixed against axial movement along the handle so that the user must develop a certain dexterity and skill in order to maintain the handgrips in proper relation to the handle and hoop portions. This feature also makes it possible for the user to space his hands apart a distance which is most comfortable to him.

Symmetrically arranged on opposite sides of the elliptical hoop portion are a pair of noisemakers, such as vibrating reed elements, responsive to relative wind velocity, i.e., the velocity at which the user swings the hoop through the air. At a certain minimum wind velocity, the noisemaker devices are inoperative, that is, any sound or acoustic vibrations emitted thereby are inaudible. As wind velocity past the noisemaker element increases above the aforesaid minimum velocity as the user swings the hoop faster and faster, the noisemaker will emit a sound or tone of greater and greater intensity.

With these and other objects, advantages and features of the invention may become hereinafter apparent, the nature of the invention may be more clearly understood by reference to the following detailed description of the invention, the appended claims and to the several views illustrated in the attached drawing, wherein:

DETAILED DESCRIPTION OF A PREFERRED EMBODIMENT

Figure 1:
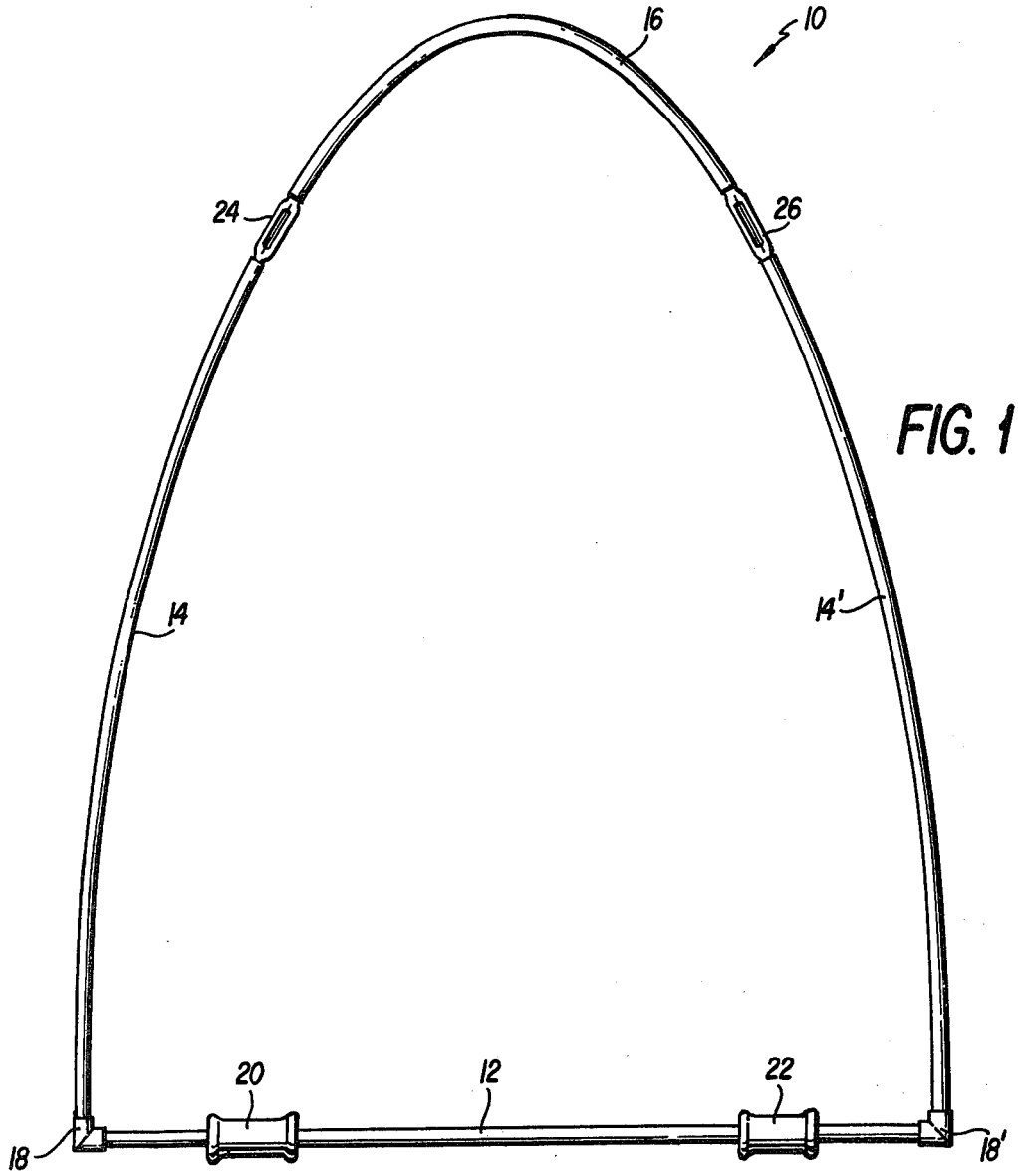
FIG. 1 is a front elevational view of the skipping hoop apparatus according to the present invention.
Figure 3:
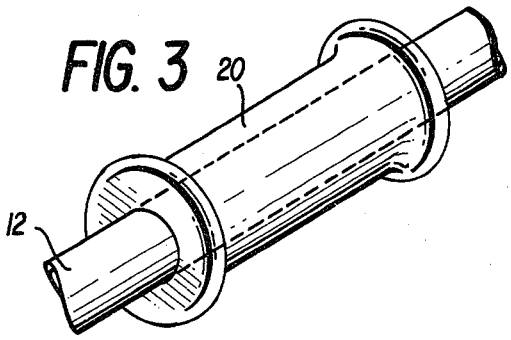
FIG. 3 is a broken perspective view showing a portion of the handle and one handgrip of the hoop of the present invention.

Referring now in detail to the drawings, there is illustrated in FIG. 1 a skipping hoop constructed according to a preferred embodiment of the invention and designated generally by reference numeral 10. Hoop 10 comprises four interconnected sections of a semi-rigid plastic pipe, including an elongate handle portion 12, two curved side portions 14, 14' and a curved end portion 16. The ends of the handle portion 12 are connected to a respective side portion 14, 14' with plastic right-angle elbows 18, 18' which are threaded, solvent cemented or otherwise suitably mechanically or adhesively connected to the plastic pipes. A pair of tubular handgrips 20, 22 are mounted on handle 12 so as to be axially slidable therealong as best seen in FIG. 3. The handgrips 20, 22 are also formed of semi-rigid plastic pipe and may be broadened or flanged at the ends thereof by heating to form rims with a gripping portion therebetween. The handgrips 20, 22 are adapted to be grasped by the user and moved in such a way as to rotate the handle 12 about its longitudinal axis.

A pair of noisemaker elements 24, 26 interconnect the ends of the curved portion 16 of the hoop with a respective side portion 14, 14' of the hoop. As FIG. 1 illustrates, the side portions 14, 14', the noisemaker elements 24, 26 and the curved end portion 16 form one-half of an ellipse.

Figure 2:
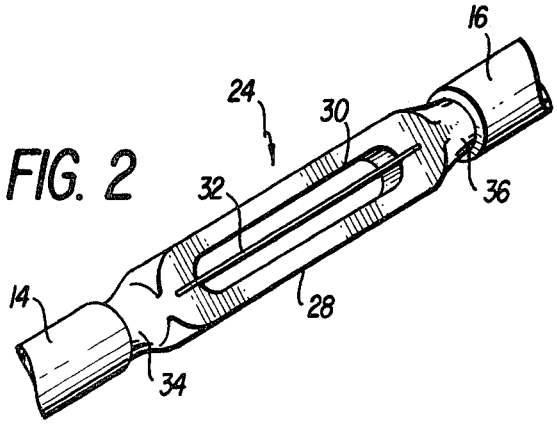
FIG. 2 is a broken perspective view showing details of one of the noisemaker elements of the hoop of the present invention.

A preferred embodiment of the noisemakers is shown in FIG. 2 wherein it will be seen that the noisemaker element 24 comprises a generally rectilinear body portion 28 having an elongate slot 30 therethrough. The noisemaker body 28 is preferably formed of a plastic material; however, it may be formed of metal, wood or other suitable material. In slot 30, there is arranged a tensioned reed element 32. It will be appreciated that increasing air velocity through the slot 30, as a result of swinging the hoop, will set up vibrations in the reed element 32, and above a certain minimum air velocity, an audible sound will be generated by the vibrating reed.

A pair of cylindrical end members 34, 36 are integrally formed with and extend from opposite ends of the body 28 of the noisemaker. These end members are of a diameter to fit tightly within the inside diameters of the pipe portions 14 and 16 of the hoop. The noisemaker element 26 is of substantially identical construction as noisemaker 24; however, it will be appreciated that the noisemaker 26 may be constructed to generate an audible sound or tone at a frequency different than that of noisemaker 24 or at a minimum velocity different than that of noisemaker 24. A different frequency tone could be accomplished by varying the stiffness or tension of the reed. The position of the noisemakers along the elliptical hoop portion will influence the velocity necessary to initiate the audible sound. It should be understood that wind velocity responsive noisemakers other than vibrating reed noisemakers may be used in the present invention.

Although only a preferred embodiment is specifically illustrated and described herein, it will be appreciated that many modifications and variations of the present invention are possible in light of the above teachings and within the purview of the appended claims without departing from the spirit and intended scope of the invention.

What I claim is:

1. A skipping hoop apparatus comprising:

a curved hoop member comprising a pair of side members and an end member formed of segments of plastic pipe;

handle means connected to said hoop side members for swinging the hoop member in a circular motion about the axis of the handle means;

a tubular handgrip arranged about said handle means, said handgrip being freely slidable along the longitudinal axis of said handle means; and noisemaker means for generating an audible signal in response to an airstream passing thereover when said hoop member is swung in said circular motion, said noisemaker means comprising a pair of vibrating reed noisemakers, each having a body member including an elongate slot therethrough and a tensioned reed element affixed in said slot, a respective body member interposed between and interconnecting the hoop end member with a respective one of the hoop side members.

2. The skipping hoop according to claim 1, wherein said hoop member is substantially elliptically shaped.

3. The skipping hoop according to claim 1, wherein said hoop member and handle means are interconnected by plastic right-angle elbows.

* * * * *